US008601615B2

(12) United States Patent
Isaacson et al.

(10) Patent No.: US 8,601,615 B2
(45) Date of Patent: Dec. 10, 2013

(54) SHIRT HOLD-DOWN UNDERGARMENT

(75) Inventors: Kasandra Isaacson, Hudson Falls, NY (US); Kim M. Vanyo, Saratoga Springs, NY (US)

(73) Assignee: Kasandra Isaacson, Saratoga Springs, NY (US)

( * ) Notice: Subject to any disclaimer, the term of this patent is extended or adjusted under 35 U.S.C. 154(b) by 165 days.

(21) Appl. No.: 12/729,665

(22) Filed: Mar. 23, 2010

(65) Prior Publication Data

US 2010/0235969 A1 Sep. 23, 2010

Related U.S. Application Data

(60) Provisional application No. 61/162,437, filed on Mar. 23, 2009.

(51) Int. Cl.
*A41B 9/00* (2006.01)

(52) U.S. Cl.
USPC ..... 2/400; 2/406; 2/117; 2/323; 2/340; 450/111

(58) Field of Classification Search
USPC ..... 2/400, 402–404, 406, 407, 229–231, 2/112, 117, 78.4, 238, 240, 340, 326, 2/78.1, 78.3, 228, 241, 242, 302–304, 2/306, 300, 311, 312, 405, 409, 73, 109, 2/113, 1, 79; 450/14, 26, 28, 29, 110, 450/111, 112–155, 96–109; 128/891, 885, 128/96.1; D2/701, 743, 700; 604/397, 398, 604/399
See application file for complete search history.

(56) References Cited

U.S. PATENT DOCUMENTS

| | | | | | |
|---|---|---|---|---|---|
| 148,193 | A | * | 3/1874 | Dunbar | 2/229 |
| 388,075 | A | * | 8/1888 | Saeger | 2/229 |
| 730,137 | A | * | 6/1903 | Livingston | 2/328 |
| 925,121 | A | * | 6/1909 | Melze | 602/67 |
| 932,640 | A | * | 8/1909 | Pfiffner | 2/70 |
| 937,724 | A | * | 10/1909 | Small | 128/98.1 |
| 948,199 | A | * | 2/1910 | Anderson | 2/77 |
| 959,441 | A | * | 5/1910 | Anderson | 2/67 |
| 1,199,689 | A | * | 9/1916 | Gewandter | 2/78.4 |
| 1,347,180 | A | * | 7/1920 | Schopbach | 450/111 |
| 1,560,890 | A | * | 11/1925 | Whitlock | 604/396 |
| 1,566,109 | A | * | 12/1925 | McKeefrey | 450/30 |
| 1,653,288 | A | * | 12/1927 | Johnson | 2/326 |
| 1,763,266 | A | * | 6/1930 | Simmons | 2/407 |
| 1,817,360 | A | * | 8/1931 | Fridolph | 2/407 |
| 1,840,621 | A | * | 1/1932 | Dwyer | 602/67 |
| 1,883,341 | A | * | 10/1932 | Dauphinais | 2/404 |
| 1,998,085 | A | * | 4/1935 | Jones | 2/78.2 |
| 2,064,977 | A | * | 12/1936 | Kahn | 450/111 |
| 2,126,905 | A | * | 8/1938 | McCracken | 604/397 |
| 2,246,714 | A | * | 6/1941 | Blair | 2/407 |
| 2,298,737 | A | * | 10/1942 | Kattermann et al. | 450/116 |
| 2,323,718 | A | * | 7/1943 | Madden et al. | 2/407 |
| 2,333,268 | A | * | 11/1943 | Moon | 450/13 |

(Continued)

*Primary Examiner* — Khoa Huynh
*Assistant Examiner* — Brieanna Fuller
(74) *Attorney, Agent, or Firm* — Schmeiser, Olsen & Watts

(57) ABSTRACT

Disclosed herein is an undergarment that includes a body and a first elongated loop attached to a front side of the body configured to receive an attachment mechanism of a shirt hold-down device. The undergarment further includes a second elongated loop attached to a back side of the body configured to receive an attachment mechanism of a shirt hold-down device.

7 Claims, 15 Drawing Sheets

(56) References Cited

U.S. PATENT DOCUMENTS

| | | | | | |
|---|---|---|---|---|---|
| 2,333,839 | A | * | 11/1943 | Blackburn et al. | 128/98.1 |
| 2,348,242 | A | * | 5/1944 | Bullinger | 2/402 |
| 2,365,016 | A | * | 12/1944 | Spanel | 450/97 |
| 2,493,831 | A | * | 1/1950 | Prevost | 450/111 |
| 2,505,242 | A | * | 4/1950 | Herbener | 2/336 |
| 2,508,049 | A | | 5/1950 | Tuck | |
| 2,522,375 | A | * | 9/1950 | Jones | 2/407 |
| 2,525,666 | A | * | 10/1950 | Glynn | 450/14 |
| 2,545,099 | A | * | 3/1951 | Mann | 604/394 |
| 2,570,987 | A | * | 10/1951 | Rose | 450/111 |
| 2,591,423 | A | * | 4/1952 | Grolitzer | 450/104 |
| 2,595,031 | A | * | 4/1952 | Wanish | 450/130 |
| 2,632,165 | A | * | 3/1953 | Murdock | 450/111 |
| 2,659,084 | A | * | 11/1953 | Trznadel | 450/123 |
| 2,671,222 | A | * | 3/1954 | Meyer | 2/400 |
| 2,711,542 | A | * | 6/1955 | Rosenberg | 2/407 |
| 2,727,247 | A | | 12/1955 | Bailey | |
| 2,763,008 | A | * | 9/1956 | Rosenthal | 450/104 |
| 2,806,221 | A | * | 9/1957 | Dorsey | 450/97 |
| 2,876,779 | A | * | 3/1959 | Ebert | 450/104 |
| 2,904,048 | A | * | 9/1959 | Schamber | 450/116 |
| 3,035,586 | A | * | 5/1962 | Bell | 450/100 |
| 3,052,891 | A | * | 9/1962 | Panepinto | 2/301 |
| 3,075,532 | A | * | 1/1963 | Dodge | 450/97 |
| 3,130,730 | A | * | 4/1964 | Zanca | 450/100 |
| 3,245,410 | A | * | 4/1966 | Martin | 450/117 |
| 3,324,857 | A | * | 6/1967 | Froehlich | 450/111 |
| 3,335,721 | A | * | 8/1967 | Gastwirth | 604/391 |
| 3,418,659 | A | * | 12/1968 | Brown | 2/70 |
| 3,463,162 | A | * | 8/1969 | Heggie | 450/95 |
| 3,520,304 | A | * | 7/1970 | Flowers et al. | 604/396 |
| 3,543,763 | A | * | 12/1970 | Porco | 450/111 |
| 3,566,411 | A | * | 3/1971 | Gordon | 2/240 |
| 3,761,961 | A | * | 10/1973 | Martin et al. | 2/78.3 |
| 3,880,160 | A | * | 4/1975 | Hall | 602/70 |
| 3,931,816 | A | * | 1/1976 | Waldmann | 602/19 |
| 4,074,364 | A | | 2/1978 | Lucero | |
| 4,596,569 | A | | 6/1986 | Campbell | |
| 4,597,109 | A | | 7/1986 | Hironaga | |
| 4,822,317 | A | * | 4/1989 | Wimmer | 450/14 |
| 4,853,979 | A | | 8/1989 | Ryder | |
| D309,020 | S | * | 7/1990 | Coates et al. | D24/126 |
| 4,937,886 | A | | 7/1990 | Ellis | |
| 5,012,802 | A | * | 5/1991 | Bischoff | 602/73 |
| 5,033,121 | A | | 7/1991 | Larsen | |
| 5,177,813 | A | | 1/1993 | Bosack et al. | |
| 5,177,814 | A | | 1/1993 | Courtney | |
| 5,276,923 | A | | 1/1994 | Cohen | |
| 5,754,982 | A | | 5/1998 | Gainer | |
| 5,819,381 | A | * | 10/1998 | Lake | 24/564 |
| 6,023,789 | A | * | 2/2000 | Wilson et al. | 2/228 |
| 6,159,070 | A | * | 12/2000 | Schwartz et al. | 450/155 |
| 2010/0095433 | A1 | * | 4/2010 | Turkbas | 2/228 |
| 2012/0246805 | A1 | * | 10/2012 | Jones | 2/400 |

* cited by examiner

SHIRT HOLD-DOWN UNDERGARMENT

RELATED APPLICATION

The present invention is a non-provisional claiming priority to a commonly owned U.S. Provisional Patent Application Ser. No. 61/162,437, filed Mar. 23, 2009, of Isaacson, entitled "Shirt Hold-Down Undergarment," the disclosure of which is herein incorporated by reference to the extent not inconsistent with the present disclosure.

FIELD OF THE INVENTION

The subject matter disclosed herein relates generally to undergarments. More particularly, the subject matter relates to an undergarment having a shirt hold-down device.

BACKGROUND OF THE INVENTION

It is often the case that the wearer of a shirt desires to tuck the shirt into his or her pants, shorts, skirt or the like. Many shirts are designed with the intention of being tucked in, such as men's formal wear, and many women's blouses. Indeed, tucking a shirt in is often perceived as professional, and has the aesthetic bonus of making the wearer look slimmer and sometimes even broader shouldered. Certain professions, such as the police or military, actually require the uniform of the wearer to be worn having the shirt tucked in. Whether the wearer is required by uniform or simply enjoys the aesthetic nature of a properly tucked shirt, it is unwelcome when the movements of the wearer cause the shirt to untuck or come loose from the pants. This occurs quite often when the shirt is short in length and does not extend very far below the wearer's waistline. In this situation, the shirt very little material being tucked into the article of clothing being worn below the waist. Many blouses or polo shirts, for example, have shorter lengths in this manner, but are often aesthetically pleasing to tuck in. Additionally, even longer length shirts may come partially untucked and look loose and displeasing aesthetically.

"Shirt stays" are a device known in the art which connect the bottom of the wearer's shirt to the top of the wearer's hosiery or socks. "Shirt stays" are often worn by many wearers in uniform, such as military wearers. However, they are neither comfortable nor attractive. A typical shirt stay consists of two long elastic bands with a clip at both ends. When the wearer of a shirt stay sits the elastic bands often chafe against the wearer's legs and sometimes even come undone thereafter snapping against the wearer's unprotected skin.

Thus, a comfortable and everyday undergarment having a shirt hold-down device would be well received in the art.

BRIEF DESCRIPTION OF THE INVENTION

According to one aspect of the invention, an undergarment comprises a body; a first elongated loop attached to a front side of the body configured to receive an attachment mechanism of a shirt hold-down device; and a second elongated loop attached to a back side of the body configured to receive an attachment mechanism of a shirt hold-down device.

According to another aspect of the invention, an undergarment comprises a body having a stitched seam, the stitched seam attaching two edges of material of the body; a first fabric strip extending from the stitched seam; and a first hold-down device attachable to the first fabric strip, the first hold-down device attachable to an article of clothing to be worn by a wearer substantially above a waist of the wearer.

According to yet another aspect of the invention, an undergarment comprises a body; a first elongated loop attached to a front side of the body configured to receive an attachment mechanism of a shirt hold-down device; and a first hold-down device having a hook that is removably attachable to the first elongated loop, the first hold-down device having a hold down mechanism that is attachable to an article of clothing to be worn by a wearer substantially above a waist of the wearer.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

A detailed description of the hereinafter described embodiments of the disclosed apparatus and method are presented herein by way of exemplification and not limitation with reference to the Figures.

Figure 1:
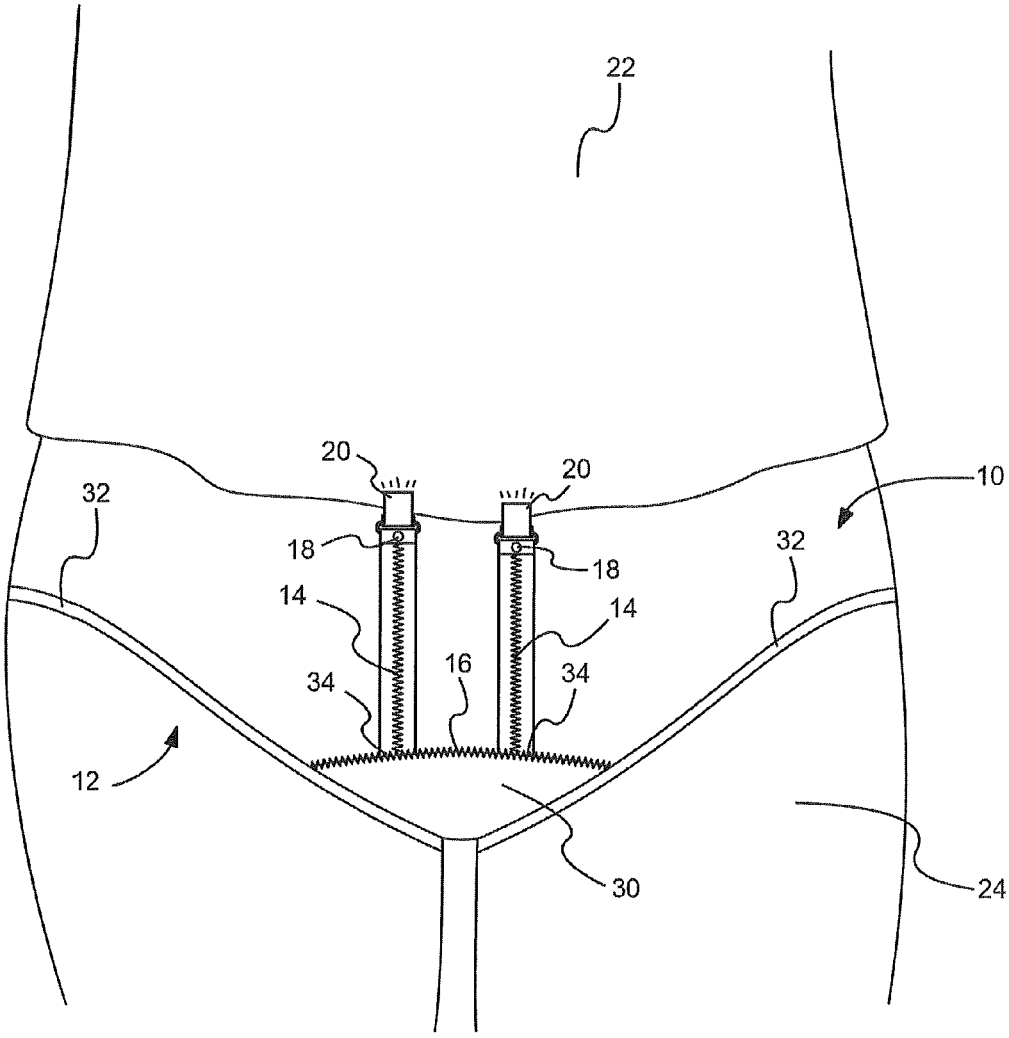
FIG. 1 depicts a perspective view of the front of a panty undergarment worn by a wearer having two hold-down devices, each gripping a shirt according to one embodiment of the present invention.

Referring firstly to FIG. 1, a perspective view of a front side 10 of a panty undergarment 12 is shown having two fabric strips 14 extending from a front main seam 16 of the undergarment 12. Each of the fabric strips 14 extends to an attachment mechanism 18. A hold-down device 20 is removably attachable to each of the attachment mechanisms 18. Each of the hold-down devices 20 is also removably attachable to the fabric of a shirt 22 whereby the hold-down devices 20 are configured to prevent the shirt 22 from becoming untucked, or coming loose, due to the movements of a wearer 24.

Figure 2:
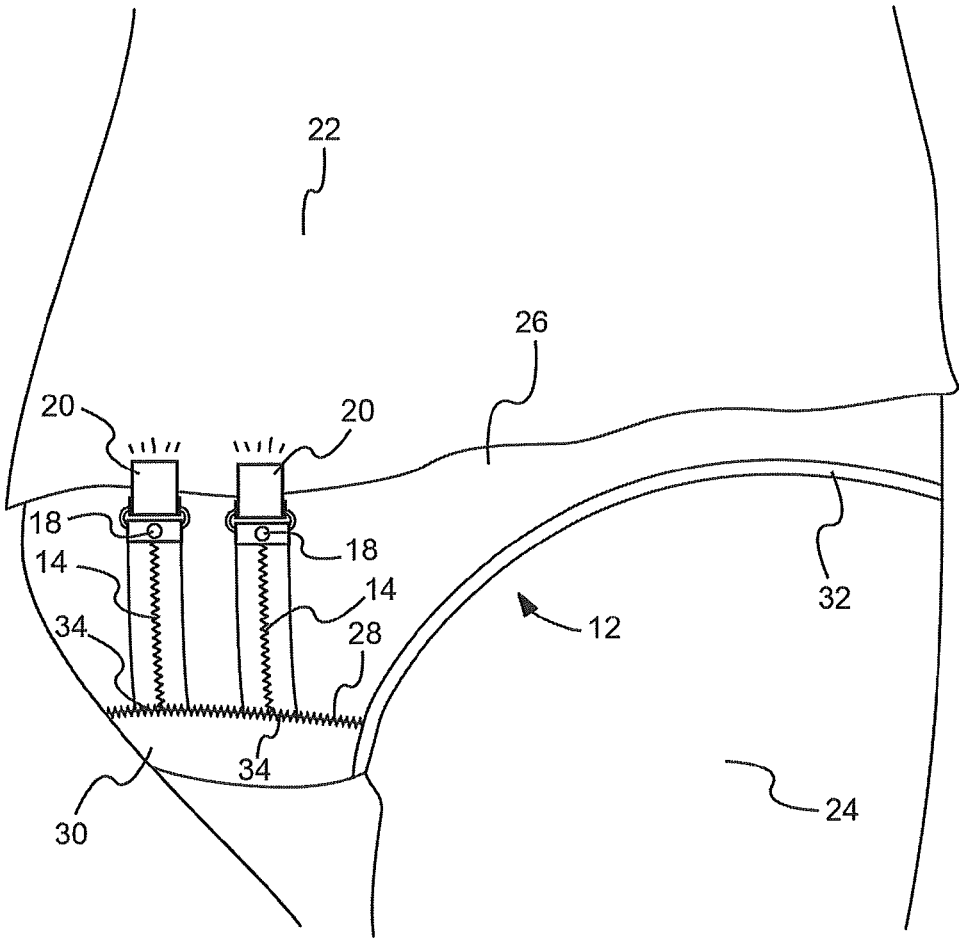
FIG. 2 depicts a perspective view of the back of the panty of FIG. 1 being worn by the wearer and having two more hold-down devices gripping the shirt.

As shown in FIG. 2, a back side 26 of the panty undergarment 12 includes a similar arrangement. Two of the fabric strips 14 are shown, similarly extending from a back main seam 28. Each of the fabric strips 14 extends to one of the attachment mechanisms 18. One of the hold-down devices 20 is removably attachable to each of the attachment mechanisms 18. Each of the hold-down devices 20 is also removably attachable to the fabric of the shirt 22 whereby the back hold-down devices 20, in conjunction with the front hold down devices 20, are configured to further retain the shirt 22 in a proper location.

In one embodiment, the fabric strips 14 comprise an elastic material. However, the fabric strips 14 may comprise any other appropriate material such as cotton, polyester, silk, wool or linen. It is also contemplated that the strips 14 are not made of fabric, but may be made of materials such as a synthetic or plastic. Furthermore, the fabric strips 14 may comprise an elastic stitch that provides for elasticity and flexibility in the fabric strips 14, further allowing the fabric strips 14 to stretch out when tension is applied by the pull of the shirt 22 on the hold-down devices 20. This elasticity also allows tension to be applied on the hold-down devices 20 from the shirt 22 and helps alleviate any bunching of the fabric of the panty undergarment 12 while also relieving stress on stitching or other attachment mechanisms between the fabric strips 14 and the undergarment 12. However, other stitches of the fabric strips 14 are contemplated and may be appropriate as would be understood by those skilled in the art. An elastic stitch may also be used to attach the fabric strips 14 to the panty undergarment 12. Other attachment means of the fabric strips 14 to the panty undergarment 12 include other sewn stitches, buttons, fasters, snaps, glue, adhesive, epoxy or another bonding agent, hook and loop fasteners or the like.

Figure 3:
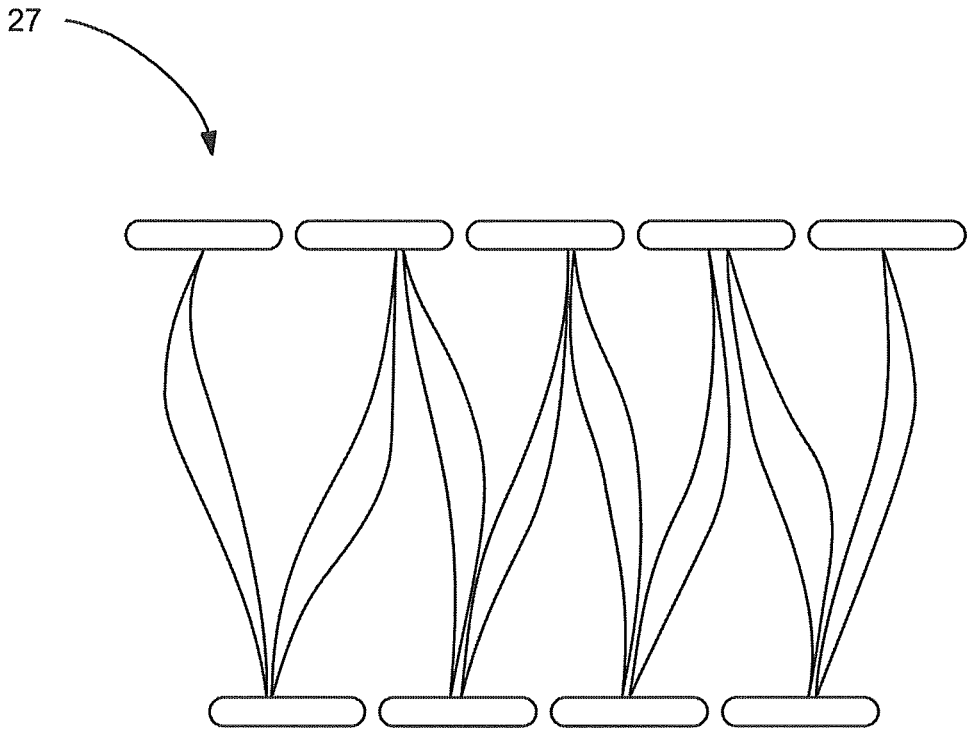
FIG. 3 depicts an exploded view of an elastic stitch.

Shown in FIG. 3 is an example of an elastic honeycomb stitch 27 that may be used to attach the fabric strips 14 to the panty undergarment 12, or to simply create the fabric strips 14 so that they are inherently elastic. Other types of elastic stitching that may be utilized include any type of zigzag stitch, a triple stretch stitch, a foundation elastic stitch, a crosshem stitch, an elastic blindhem stitch, any type of overlock stitch, any type of overcast stitch, or a mock cover hem stitch. It should be understood that this list of elastic stitching is not exhaustive. Other types of suitable stitching that may be used will be apparent to those skilled in the art.

Referring back to FIGS. 1 and 2, a portion of the fabric strips 14 proximal to the attachment mechanism 18 may not be attached to the panty undergarment 12. In this embodiment, the hold-down devices 20 loosely hang from the panty undergarment 12 from the unattached portion of the fabric strips 14. This may further help to reduce stress caused by movements of the wearer 24 at the attachment between the shirt 22 and the hold-down devices 20.

With further reference to FIGS. 1 and 2, attachment of the fabric strips 14 to the panty undergarment may be perpendicular to and extending from the main stitched seams 16, 28. This attachment location has several advantages. For example, providing attachment extending from the seams 16, 28 to the hold down devices 20 allows tension from the hold down devices 20 to be distributed evenly to the entirety of an inner section 30 of the panty undergarment 12 that connects the fabric of the front side 10 and the back side 26 of the panty undergarment 12. This attachment location also prevents the uncomfortable bunching that would be associated with the attachment of the fabric strips 14 at another location on the panty 10, such as on an elastic leg opening band 32 of the panty. Further, providing hold-down devices 12 on both the front and back sides 10, 26 of the panty undergarment 12 at this location helps prevent either the front or back side 16, 22 of the panty from riding up when respective front or back hold-down devices 20 experience pull from the shirt 22. In this situation, the opposing front or back hold down devices 20 provides a counter force to any such isolated pulling. Additionally, attaching the fabric strips 14 so that they extend from the stitched seams 16, 28 helps to prevent ripping of the material of the panty undergarment 12 at a base 34 of the fabric strip 14. It should be understood that the fabric strips 14 are not limited to being attached to extend from one of the main seams 16, 28. Furthermore, it should be understood that the location of the main seams 16, 28 may change, and along with it the location of the perpendicularly extending fabric strips 14, depending on the particular style of underwear. Other styles of underwear will be described hereinafter with respect to FIGS. 6-9.

Figure 4:
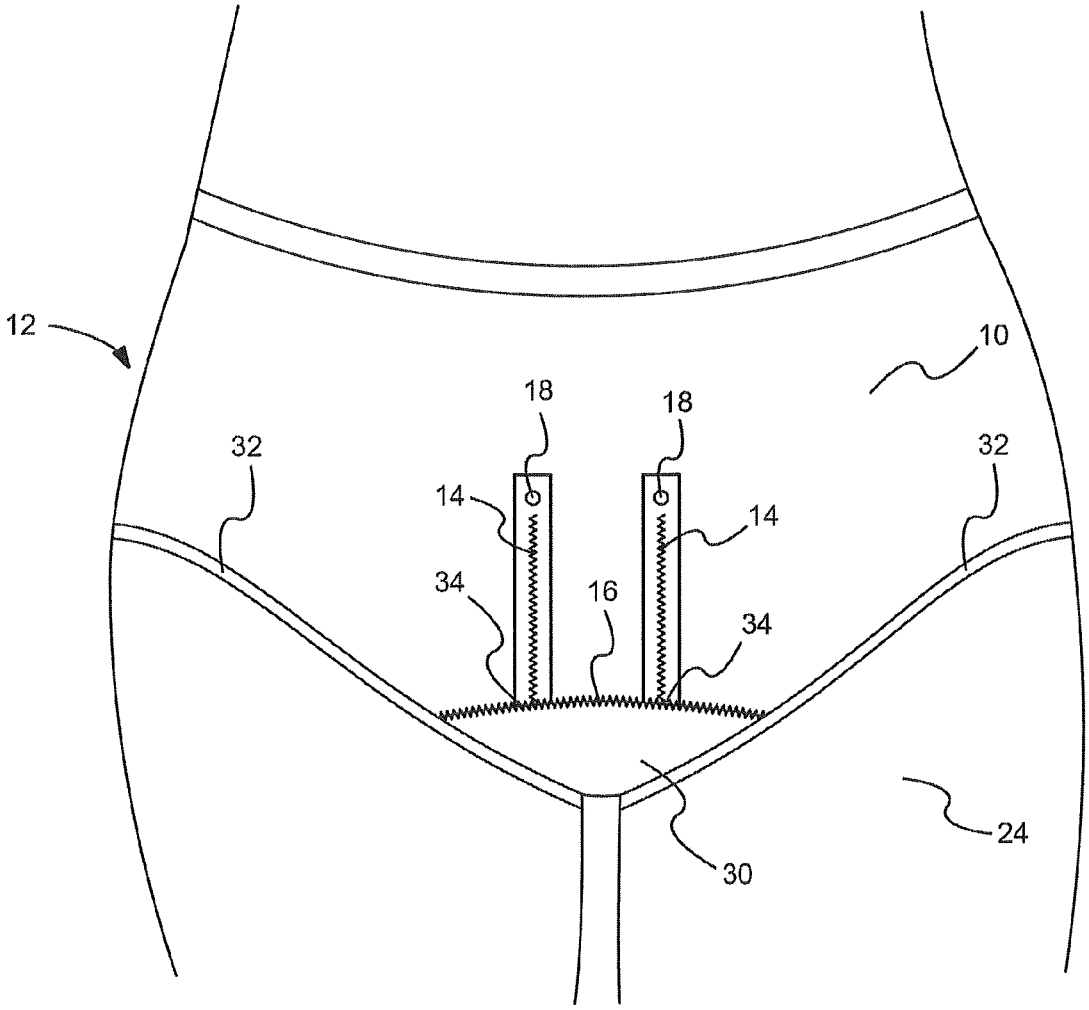
FIG. 4 depicts a perspective view of the panty undergarment of FIGS. 1-2 prior to attachment of the hold-down devices to the attachment mechanisms.

Referring now to FIG. 4, a perspective view of the panty undergarment 12 is shown prior to attachment of the hold-down devices 20 to the attachment mechanisms 18. In one embodiment, each of the attachment mechanisms 18 is a male snap button component permanently attached to the fabric strip 14 of the undergarment, and a female snap button component located on each of the hold-down devices 20 (depicted in FIGS. 1 and 2). In other embodiments, the attachment male snap button component may be permanently attached directly to the body of the panty undergarment 12. Any removable attachment mechanism may be appropriate however, such as a hook and loop fastener, a standard button, or epoxy. In all cases, the removable attachment mechanism 18 allows the wearer 24 of the panty undergarment 12 to remove the hold-down devices 20 when the wearer 24 does not require a tucked in shirt, or whenever removal of the hold-down devices is otherwise desirable. However, it should be understood that the present invention contemplates that the hold-down devices 20 may also be permanently attached.

Figure 5:
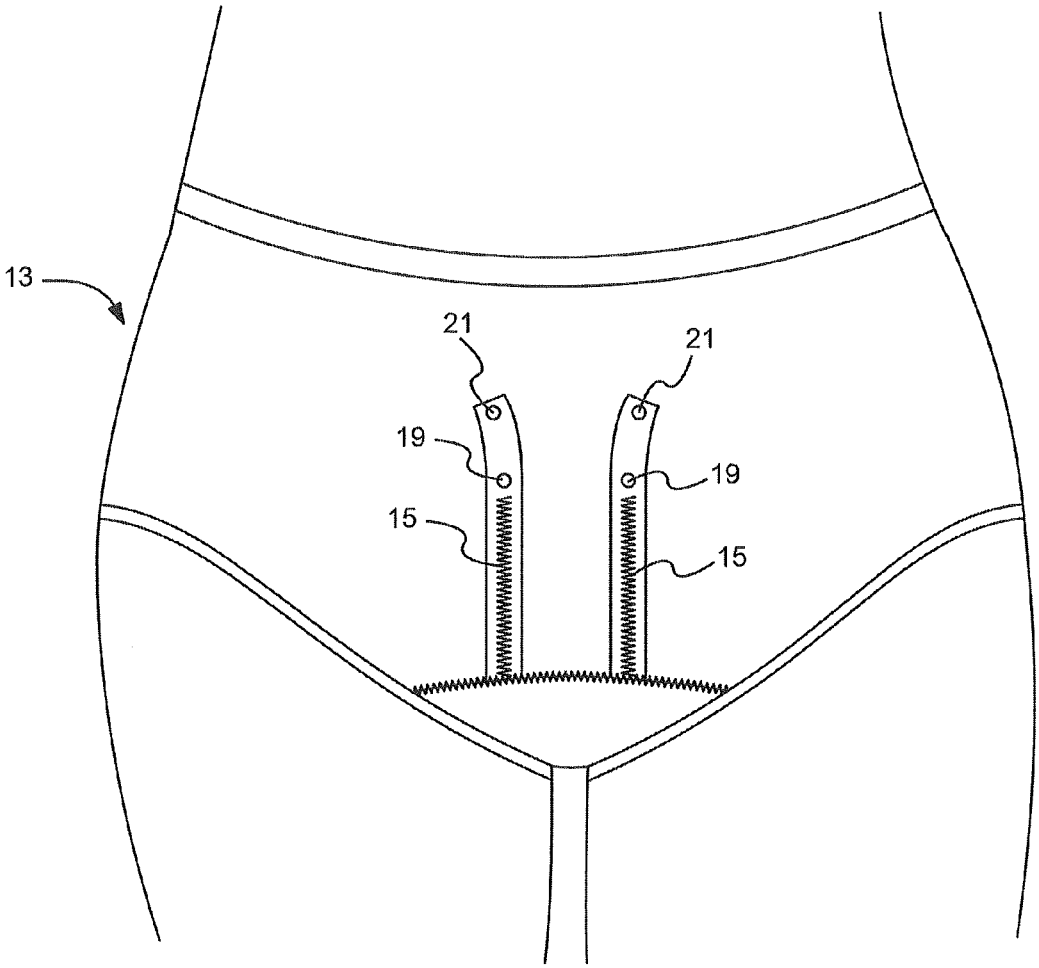
FIG. 5 depicts a perspective view of another panty undergarment prior to attachment of the hold-down devices according to one embodiment of the present invention.
Figure 6:
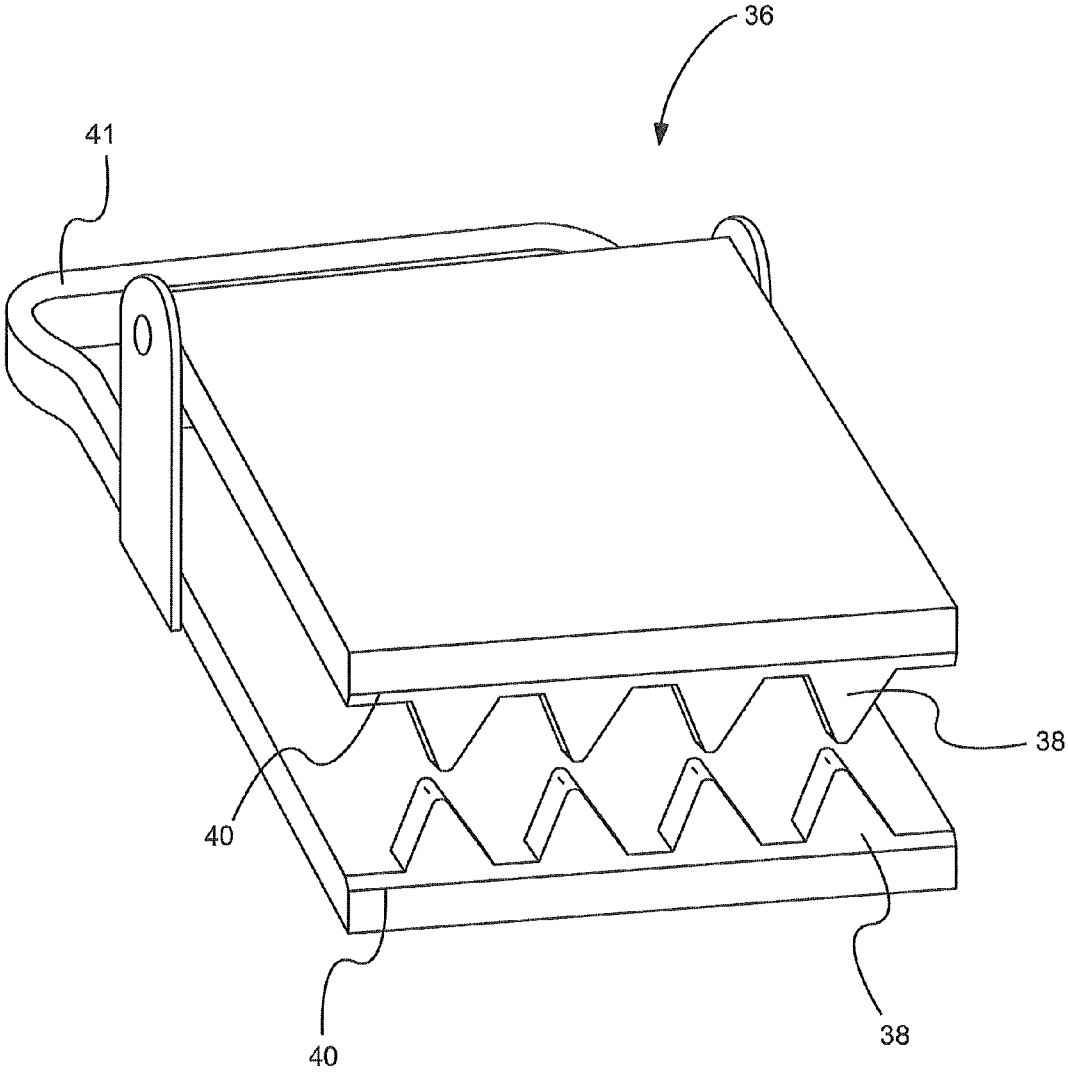
FIG. 6 depicts an exploded view of a hold-down device having teeth covered by a protective layer and an attachment loop according to one embodiment of the present invention.

Shown in FIG. 5 is a perspective view of another panty undergarment 13 having a fabric strip 15 with another attachment mechanism 19, 21. In this embodiment, a male snap button component 19 and a female snap button component 21 are attached to the fabric strip 21. When snapped together, the two snap button components 19, 21 create a loop which may facilitate attachment of a hold-down device. Shown in FIG. 6 is an exploded view of one such hold-down device 20. The hold-down device 20 includes a fixed attachment loop 41 through which the fabric strip 15 may be inserted. After insertion of the fabric strip 15 past the female snap button component 21, the snap button components 19, 21 may be snapped together, thereby securing the hold-down device 20 to the panty undergarment 13.

Referring still to FIG. 6, the clasp 36 contains a plurality of teeth 38. In one embodiment, each of the plurality of teeth 38 is metallic, and includes a protective layer 40. The protective layer 40 is configured to protect the fabric of the shirt 22 from ripping or becoming otherwise damaged from the plurality of teeth 38. The protective layer may be made of a polymer material, silicon, plastic, PVC coating, rubber, or an elastomeric material. These materials are not inclusive, and other appropriate materials may be used. In other embodiments, the hold-down device may not have teeth at all, but instead have two substantially flat sides that press the fabric of the shirt 22 together, or have more rounded protrusions rather than the pointed teeth 38. It should be understood that the hold-down device 20 is not limited to a clasp, however. In other embodiments, the hold down device is a locking fabric button arrangement, gripper, or other appropriate attaching device. Furthermore, the hold-down device 20 may not have teeth at all, but instead have one or more rounded protrusions.

The attachment mechanisms 18, 19, 21 allow different hold-down devices 20, having different properties and designs, to be utilized on the same undergarments. For example, a wearer may attach a hold-down device that has a protective coating when they are wearing a shirt of a more delicate fabric, and attach another hold-down device that has a tighter clasp and no protective coating when wearing a shirt having a more robust fabric. Additionally, the hold-down devices may include decorative qualities such that a wearer may choose a particular hold-down device for its aesthetics.

Figure 7:
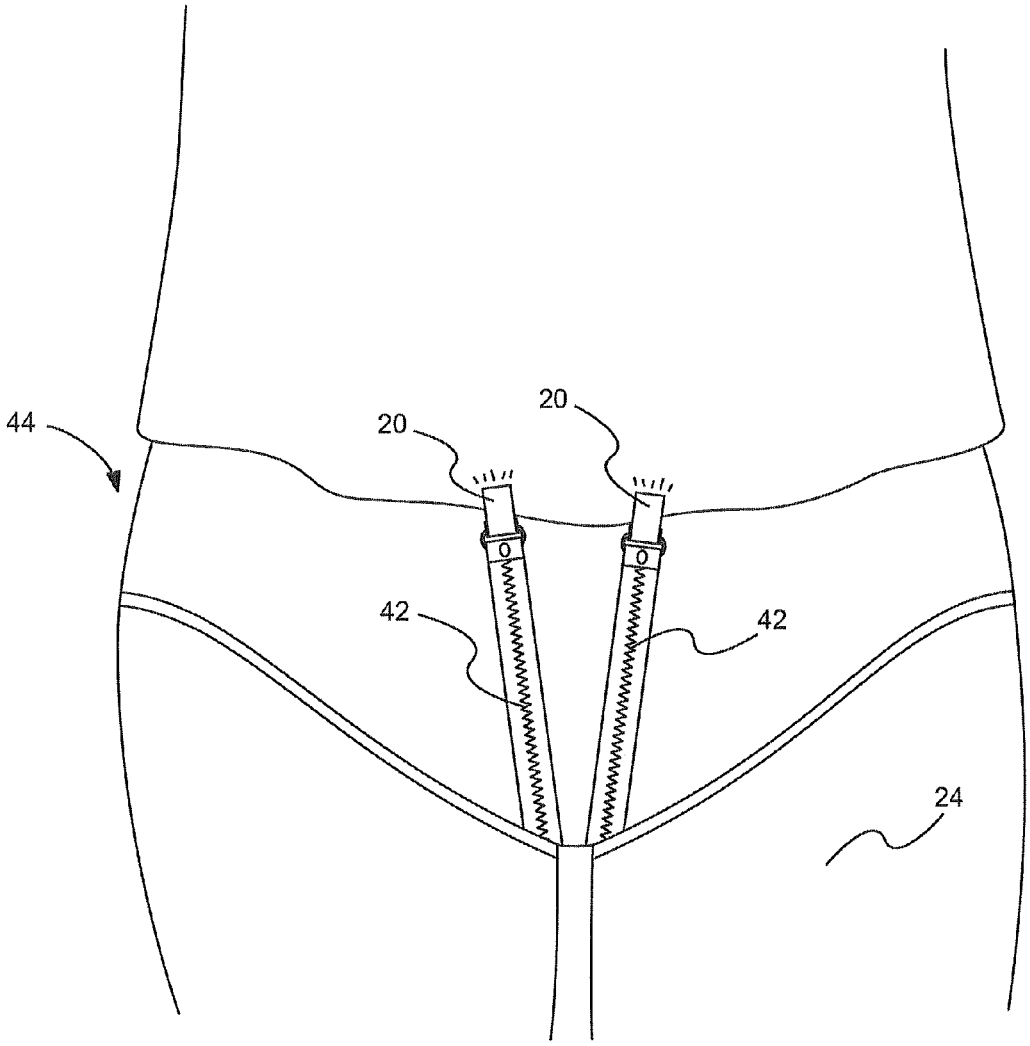
FIG. 7 depicts a perspective view of a panty undergarment having a shirt hold-down device attached to a fabric strip wrapping around the panty undergarment between the legs from the front to the back according to one embodiment of the present invention.

Depicted in FIG. 7 is another embodiment of the present invention. In this embodiment, two extending fabric strips 42 each extend around the panty undergarment, through an inner section 30, between the legs of the wearer 24 from the front to the back. One hold down device 20 is attached at each end of each of the extending fabric strips 42, one in the front and one in the back. The extending fabric strips 42 in this embodiment may be made of a similar material and with similar stitching as the fabric strips 14 described hereinabove. This embodiment is further configured to prevent bunching of an undergarment 44. It also provides additional support in situations of one sided tension that may be caused by certain movements of the wearer 24.

Figure 8:
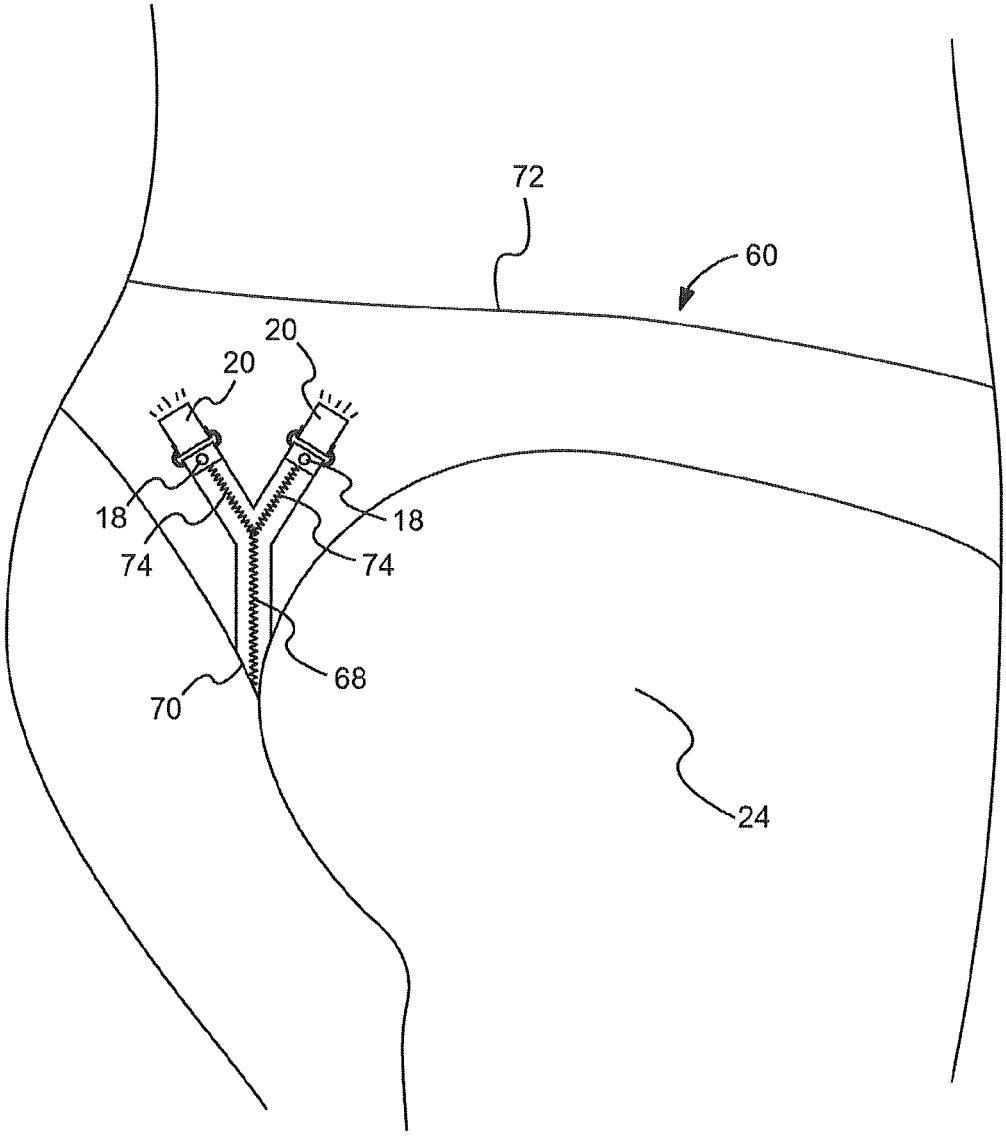
FIG. 8 depicts a perspective view of the back of a thong undergarment having two hold-down device according to one embodiment of the present invention.
Figure 9:
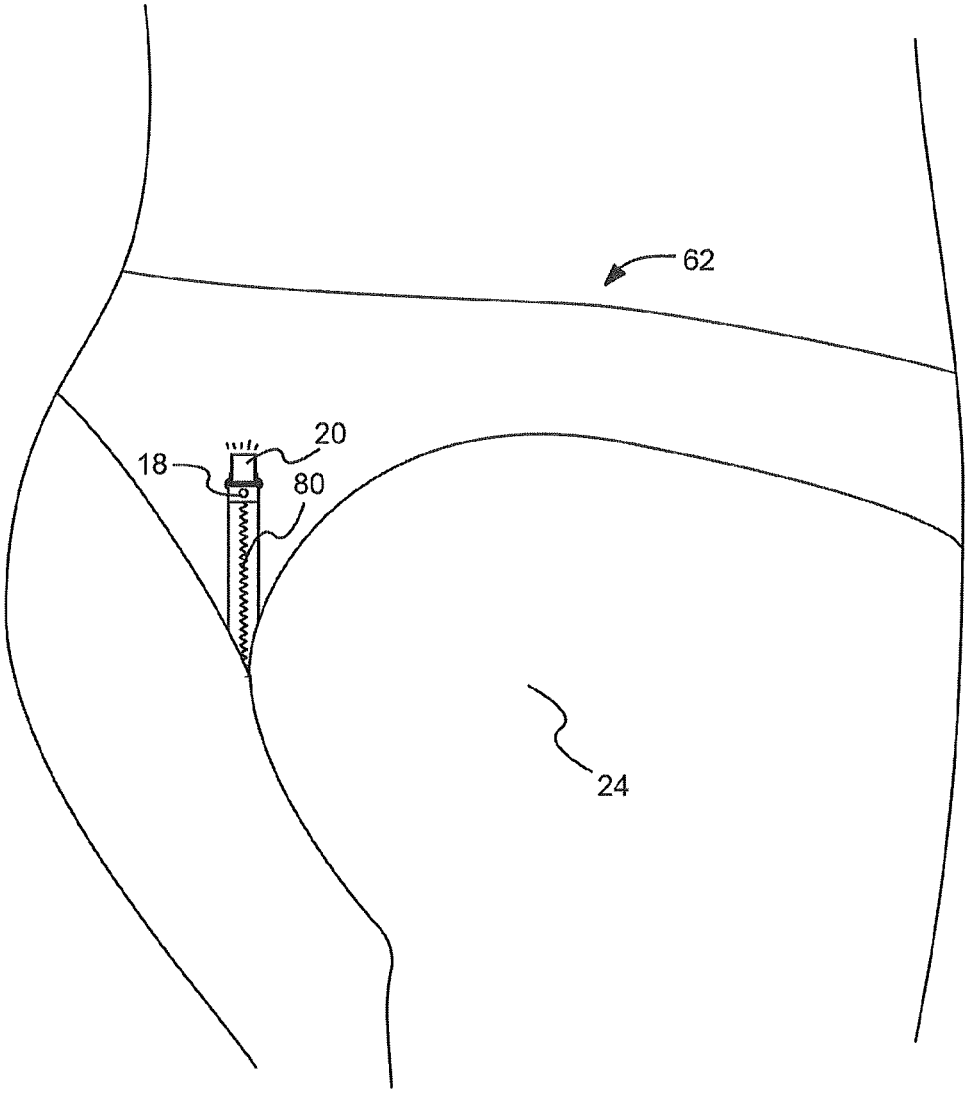
FIG. 9 depicts a perspective view of the back of a thong undergarment having one hold-down device according to one embodiment of the present invention.
Figure 10:
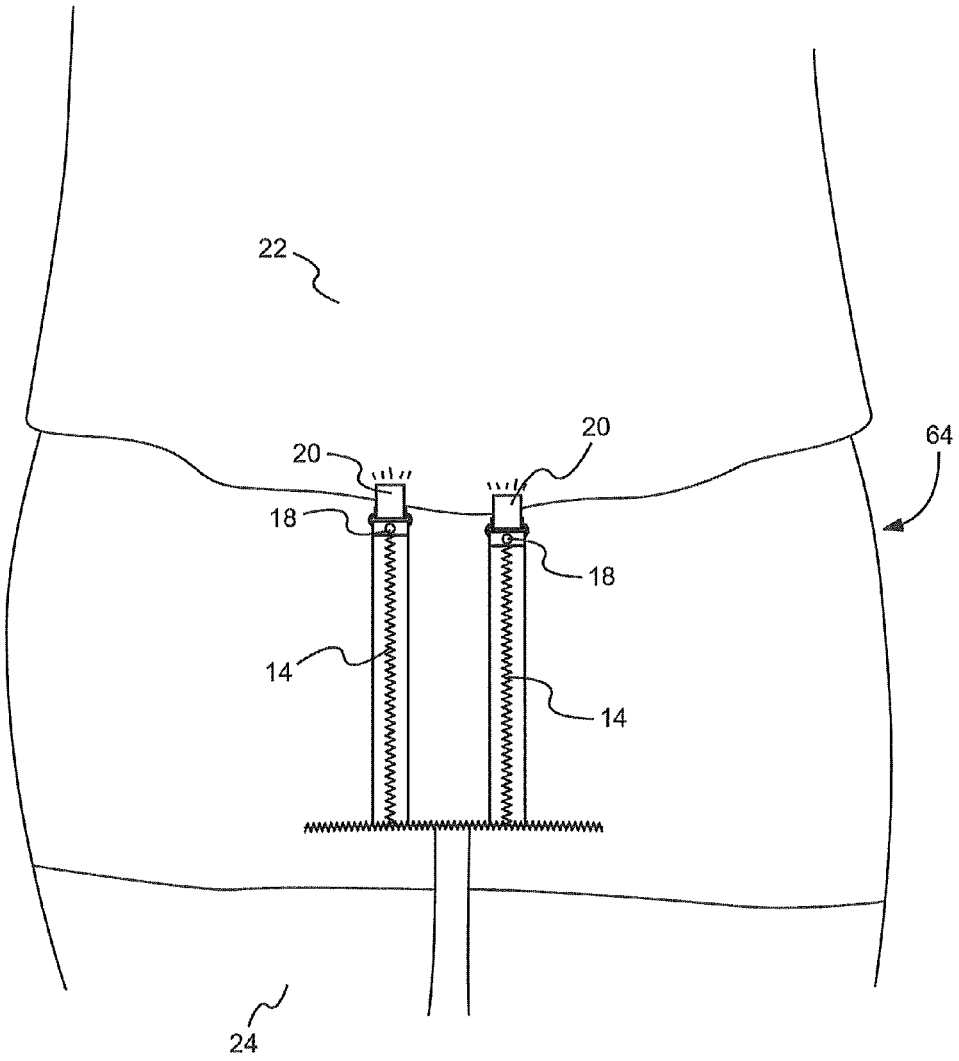
FIG. 10 depicts a perspective view of the front of a boxer-brief undergarment having two hold-down devices, each gripping a shirt according to one embodiment of the present invention.
Figure 11:
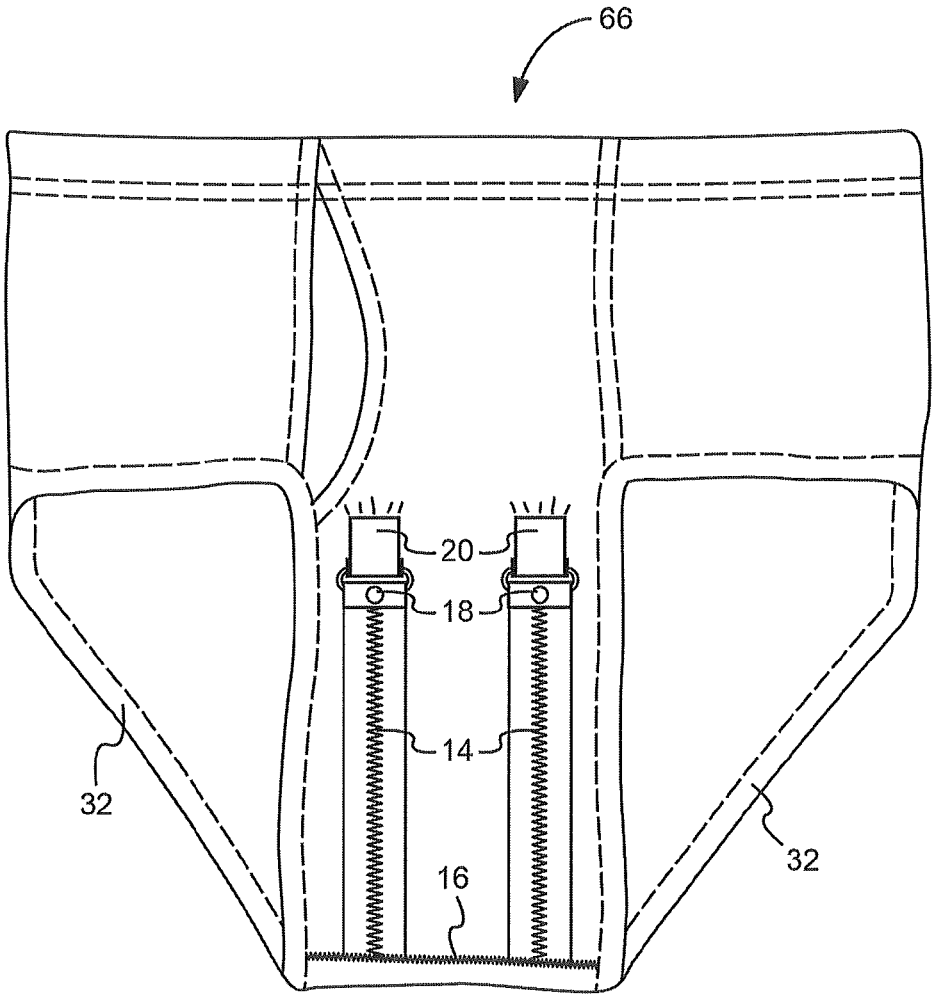
FIG. 11 depicts a perspective view of the front of a brief undergarment having two hold-down devices according to one embodiment of the present invention.

Referring now to FIGS. 8-11, various forms of undergarments are shown in accordance with the present invention. Thus, it should be understood that the fabric strips 14, 42, the hold-down devices 20, the main seams 16, 28 and the other principles described herein may be applied to any style and size of undergarment wherein the undergarments may be intended to be worn by any age group. Particularly, the present invention may be applied to a thong undergarment 60, 62, as shown in FIGS. 8 and 9, a boxer brief 64, as shown in FIG. 10, and a brief 66, as shown in FIG. 11. Additionally, as shown in FIG. 8, the fabric strip 68 may be "Y" shaped. In this embodiment, the fabric strip 68 extends from a bottom 70 of the undergarment 60 up toward a waistline 72. The fabric strip then branches out into one or more fabric strips 74, 76, each including a hold-down device 20. The hold-down devices 20 may be attached with an attachment mechanism 18, similar to the embodiments described hereinabove.

It should also be understood that any number of fabric strips 14, 68 and hold down devices 20 may be included on each side of the undergarment 12, 60, 62, 64, 66. For example, as shown in FIG. 9, a single fabric strip 80 and hold down device 20 combination is included on each side of the undergarment 62. Alternate embodiments may also include more than two fabric-strip/hold-down-device combinations on each of the front and back side of the undergarment 12, 60, 62, 64, 66.

Figure 12:
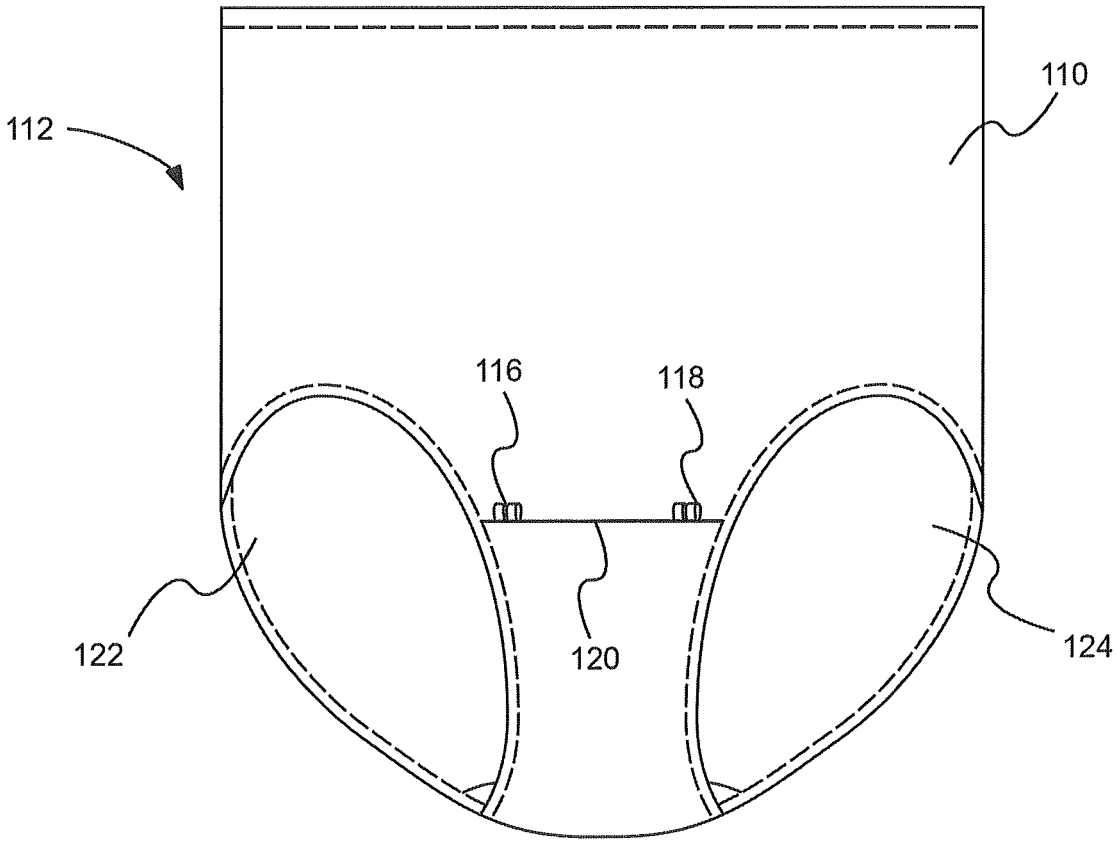
FIG. 12 depicts a front view of panty undergarment having two loops attached to the front side according to one embodiment of the present invention.
Figure 13:
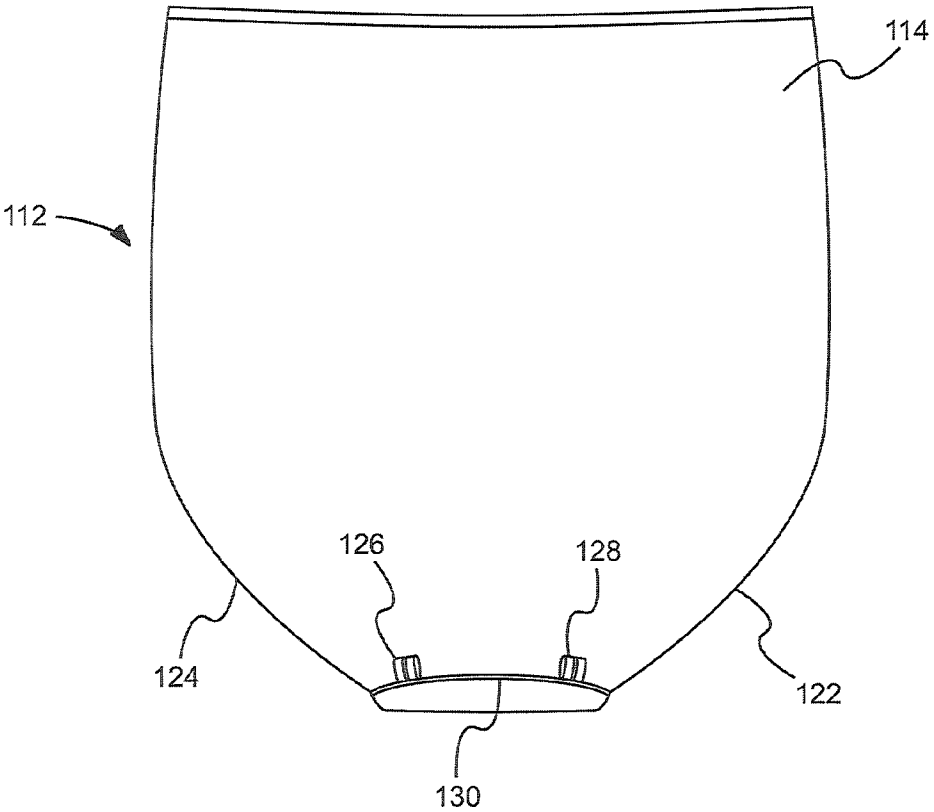
FIG. 13 depicts a back view of the panty undergarment of FIG. 12 having two loops attached to the back side according to one embodiment of the present invention.

Referring now to FIGS. 12-13, another embodiment of the present invention is shown. More particularly, FIG. 12 shows a front side 110 of a panty undergarment 112, while FIG. 13 shows a back side 114 of the panty undergarment 112. The panty undergarment 112 is comprised of a body having an interior side and an exterior side for both the front side 110 and the back side 114 that is configured to wrap around at least a waist region of a person. The body of the panty undergarment 112 includes an enclosed waist opening located at a top portion of the body, a first enclosed leg opening located at a bottom portion of the body, and a second enclosed leg opening also located at the bottom portion of the body. The panty undergarment 112 includes two loops 116, 118 on the front side 110 located along a front horizontal stitched main seam 120 on the exterior side, one loop 116 proximate a first enclosed leg opening 122 and another loop 118 proximate a second enclosed leg opening 124. It is noted that the two loops 116, 118 do not contact the first enclosed leg opening 122 and the second enclosed leg opening 124. The front horizontal stitched main seam 120 extends from a first edge of the first enclosed leg opening 122 to a first edge of the second enclosed leg opening 124 across a crotch region on the front side 110 of the panty undergarment 112. The panty undergarment 112 includes two loops 126, 128 along a back horizontal stitched main seam 130, one loop 126 proximate the second enclosed leg opening 124 and one loop 128 proximate the first enclosed leg opening 122. Further, it is noted that the two loops 126, 128 do not contact the first enclosed leg opening 122 and the second enclosed leg opening 124. The back horizontal stitched main seam 130 extends from a second edge of the first enclosed leg opening 122 to a second edge of the second enclosed leg opening 124 across a crotch region on the back side 114 of the panty undergarment 112.

The loops 116, 118, 126, 128 may be elongated such that the length of the loops 116, 118, 126, 128 is greater than their width. The loops 116, 118, 126, 128 may be made of elastic having a width of ⅝ of an inch. However, the loops 116, 118, 126, 128 may also be made of any other appropriate material, such as fabric, plastic, or the like. The elastic may be folded over and sewn to the panty undergarment 110 along the main seams 120, 130.

Figure 14:
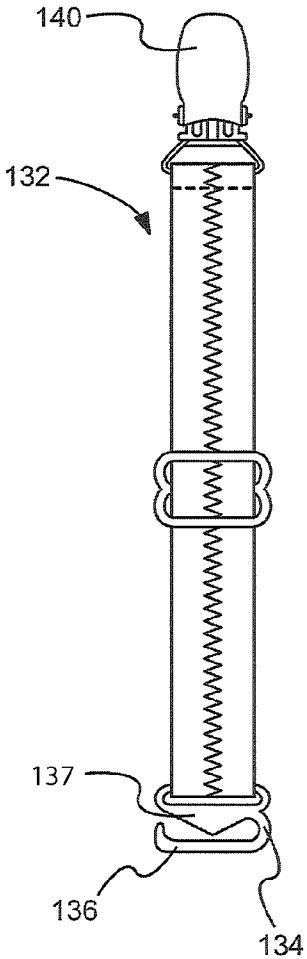
FIG. 14 depicts a detachable hold down device according to one embodiment of the present invention.

The loops 116,118, 126,128 may be configured to receive the detachable shirt hold down device 132, shown detached in FIG. 14. The detachable shirt hold down device 132 is shown having a hook 134 at one end with a finger 136 that is insertable into, and maintainable within, the loops 116, 118, 126, 128. A pointed protrusion 137 may maintain the finger 136 within the loops 116, 118, 126, 128 by gripping the fabric of the loops 116, 118, 126, 128 between the finger 136 and the pointed protrusion 137. The hook 134 may be made of a metal material. However, plastics, composites or other materials are contemplated. Further, mechanisms other than the particular finger 136 and the pointed protrusion 137 may be used to removably attach the shirt hold down device 132 to the loops 116, 118, 126, 128. Any attachment means is contemplated, such as a clip, fastener, clasp, snap, toggle or the like.

An elastic band 138 extends from the hook 134 to a hold-down mechanism 140. The elastic band 138 may be folded over such that a metal slider 142 located along the elastic band 138 may adjust the length of the elastic band 138, as is commonly known in the art. The band 138 may not be made of elastic, but may be made of a plastic, fabric, or the like. However, an elastic band 138 may be particularly advantageous because of the elasticity may allow a wearer to move without pulling the shirt out of the hold down mechanism 140.

The hold-down mechanism 140 may be a metallic thumbnail clip that is removably attachable to the fabric of a shirt, such as the shirt 22, whereby the detachable shirt hold down device 132 and the hold-down mechanism 140 are configured to prevent the shirt from becoming untucked, or coming loose, due to the movements of a wearer. It should be understood that the hold-down mechanism 140 may include any or all of the same features of the hold-down devices 20 described hereinabove. Thus, the hold-down mechanism 140 may, for example, include a protective coating.

Figure 15:
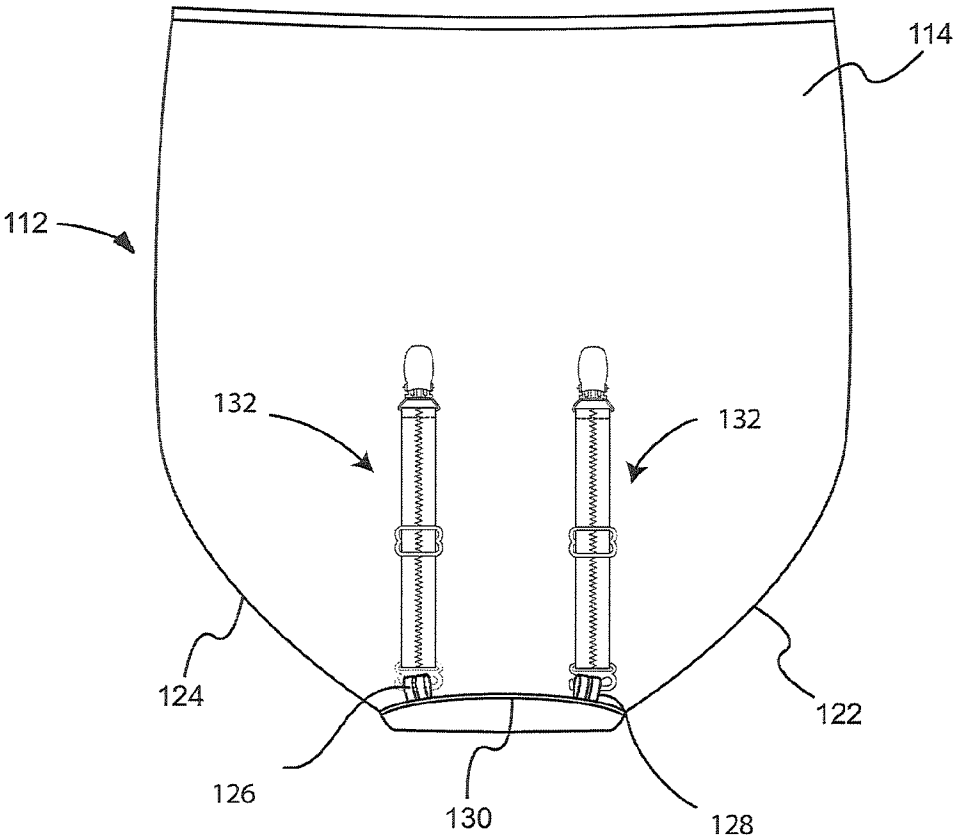
FIG. 15 depicts a back view of the panty undergarment of FIGS. 12 and 13 having detachable hold down devices attached to the loops.
Figure 16:
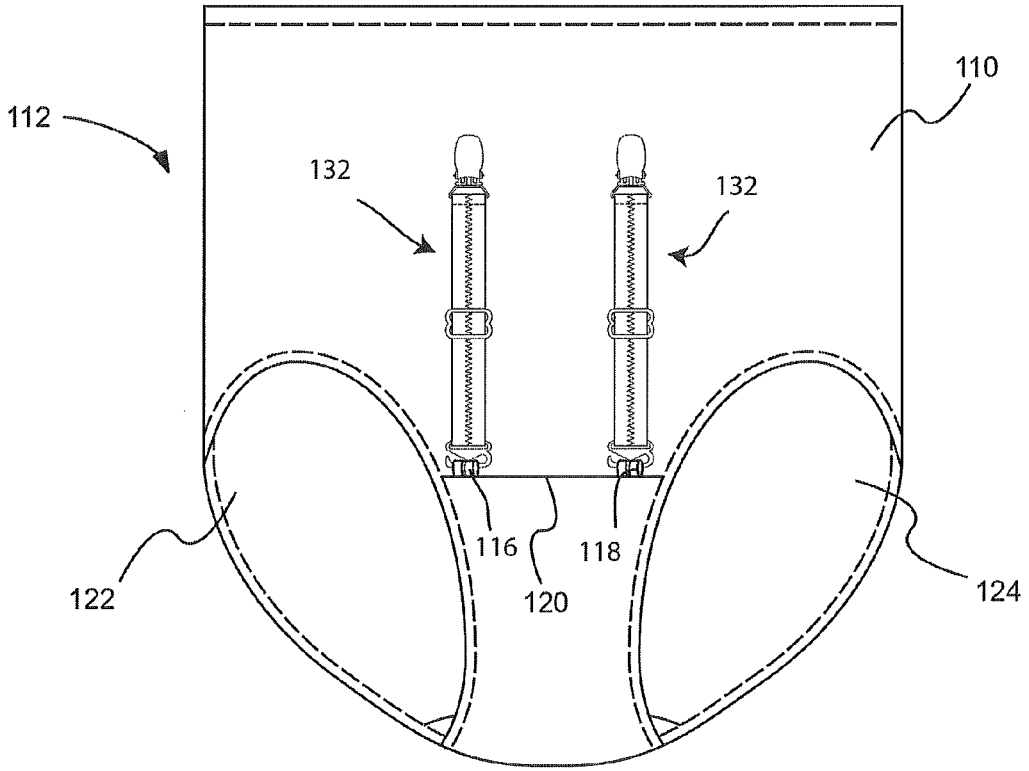
FIG. 16 depicts a front view of the panty undergarment of FIGS. 12, 13 and 15 having detachable hold down devices attached to the loops.

FIGS. 15-16 show the panty undergarment 112 of FIGS. 12-13 having the detachable shirt hold down devices 132 attached to the loops 116, 118, 126, 128. Particularly, FIG. 15 shows a back side 114 and FIG. 16 shows a front side 110 of the panty undergarment 112. It should be understood that the loops 116, 118, 126, 128 and detachable shirt hold-down device 132 combination may be applied to other undergarments and that the panty undergarment 112 is shown for the purposes of exemplification. For example, loops such as the loops 116, 118, 126, 128 may be applied to undergarments such as the undergarments 60, 62, 64, 66. In one embodiment, loops 116, 118, 126, 128 may be applied to a boxer brief undergarment (not shown). In this embodiment, the loops 116, 118, 126, 128 may be sewn into seams at the leg openings of the boxer brief. For example, a boxer brief may have leg openings having a folded seam that is stitched above the opening. The loops 116, 118, 126, 128 may be attached to this seam. The loops 116, 118, 126, 128 may be sewn into the undergarments at the seams, such as the main seams 120, 130. However, as previously described, other embodiments may not be limited to this location.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An undergarment comprising:

a body having an interior side and an exterior side configured to wrap around at least a waist region of a person, the body including an enclosed waist opening located at a top portion of the body, an enclosed left leg opening located at a bottom portion of the body, and an enclosed right leg opening located at the bottom portion of the body;

a first elongated loop attached directly to a front side of the body configured to receive an attachment mechanism of a shirt hold-down device, wherein the first elongated loop is directly stitched into a horizontal first seam located on the exterior side, wherein the horizontal first seam extends from a first edge of the enclosed left leg opening to a first edge of the enclosed right leg opening across a crotch region of the front side of the body, and wherein the first elongated loop is positioned between the enclosed left leg opening and the enclosed right leg opening on the front side of the undergarment such that the first elongated loop does not contact the enclosed left leg opening and the enclosed right leg opening; and a second elongated loop attached directly to a back side of the body configured to receive an attachment mechanism of a shirt hold-down device, wherein the second elongated loop is directly stitched into a horizontal second seam located on the exterior side, wherein the horizontal second seam extends from a second edge of the enclosed left leg opening to a second edge of the enclosed right leg opening across a crotch region of the back side of the body, and wherein the second elongated loop is positioned between the enclosed left leg opening and the enclosed right leg opening on the back side of the undergarment such that the second elongated loop does not contact the enclosed left leg opening and the enclosed right leg opening.

2. The undergarment of claim 1, further comprising a third elongated loop directly stitched into the horizontal first seam of the front side of the body configured to receive an attachment mechanism of a shirt hold-down device, wherein the third elongated loop is positioned between the enclosed left leg opening and the enclosed right leg opening on the front side of the undergarment such that the third elongated loop does not contact the enclosed left leg opening and the enclosed right leg opening; and a fourth elongated loop directly stitched into the horizontal second seam of the back side of the body configured to receive an attachment mechanism of a shirt hold-down device, wherein the fourth elongated loop is positioned between the enclosed left leg opening and the enclosed right leg opening on the back side of the undergarment such that the fourth elongated loop does not contact the enclosed left leg opening and the enclosed right leg opening.

3. The undergarment of claim 2, wherein the first, second, third, and fourth elongated loops are each made of an elastic material.

4. The undergarment of claim 1, wherein the first and second elongated loops each have a length of about ⅝ of an inch.

5. The undergarment of claim 1, wherein the undergarment is selected from a group consisting of a panty, a boxer brief, a brief, a thong, a boy short, a tanga, and a bikini underwear.

6. The undergarment of claim 1, further comprising:

an attachment mechanism of a first shirt hold-down device having a hook that is removably attachable to the first elongated loop, the first shirt hold-down device having a hold down mechanism that is attachable to an article of clothing to be worn by a wearer substantially above a waist of the wearer; and an attachment of a second shirt hold-down device having a hook that is removably attachable to the second elongated loop, the second shirt hold-down device having a hold down mechanism that is attachable to the article of clothing to be worn by the wearer substantially above the waist of the wearer.

7. The undergarment of claim 6, wherein the first and second shirt hold-down devices include teeth, and wherein the teeth include a protective coating.

* * * * *